United States Patent [19]

Stewart et al.

[11] Patent Number: 4,574,416

[45] Date of Patent: Mar. 11, 1986

[54] RETRACTABLE BRUSHES

[76] Inventors: John W. Stewart; Anne M. Stewart, both of 23 Matata Pl., Tokoroa, New Zealand

[21] Appl. No.: 636,366

[22] Filed: Jul. 31, 1984

[30] Foreign Application Priority Data

Aug. 2, 1983 [NZ] New Zealand ..... 205107

[51] Int. Cl.[4] ..... A46B 9/10

[52] U.S. Cl. ..... 15/169; 15/184; 119/88; 132/119

[58] Field of Search ..... 15/169, 184; 119/88; 132/121, 119, 122, 123, 143

[56] References Cited

U.S. PATENT DOCUMENTS

| | | | |
|---|---|---|---|
| 1,137,613 | 4/1915 | Harris | 119/88 |
| 1,169,644 | 1/1916 | Hoffman | 119/88 |
| 1,235,138 | 7/1917 | Harris | 119/88 |
| 1,388,955 | 8/1921 | Kozlowsky et al. | 132/119 |
| 2,881,460 | 4/1959 | Baudouin | 15/184 |
| 4,023,230 | 5/1977 | Friedman et al. | 15/169 X |

*Primary Examiner*—Peter Feldman

*Attorney, Agent, or Firm*—Abelman Frayne Rezac & Schwab

[57] ABSTRACT

A retractable brush in which the bristles can be retracted inside the brush body or extended therefrom by means of a bristle mounting member which is reciprocable inside the brush body and is movable between a retracted or extended position by means of a positional support member. The bristle mounting member is held in a preferred position by a locking means which automatically engages the positional support member when the bristles are extended. The positional support member is disposed such that the brush can be held and is readily actuable by one hand.

3 Claims, 4 Drawing Figures

II
II

RETRACTABLE BRUSHES

This invention relates to brushes.

It is an object of the present invention to provide a brush with retractable bristles, and more particularly a brush with bristles which retract into the body of the brush thereby providing for the easy removal of hair and other debris from the bristles.

Further objects and advantages of the present invention will become apparent from the ensuing description which is given by way of example.

According to the present invention there is provided a retractable brush comprising a body, a bristle mounting member housed within the body and supported by a positional support member, a plurality of bristles supported by said mounting member, means to actuate said positional support member so that the bristles are extensible from the body and lockable in that position, and means to actuate said positional support member to withdraw the bristles in relation to the body for the purpose of cleaning the brush.

Figures 1, 2, 3:
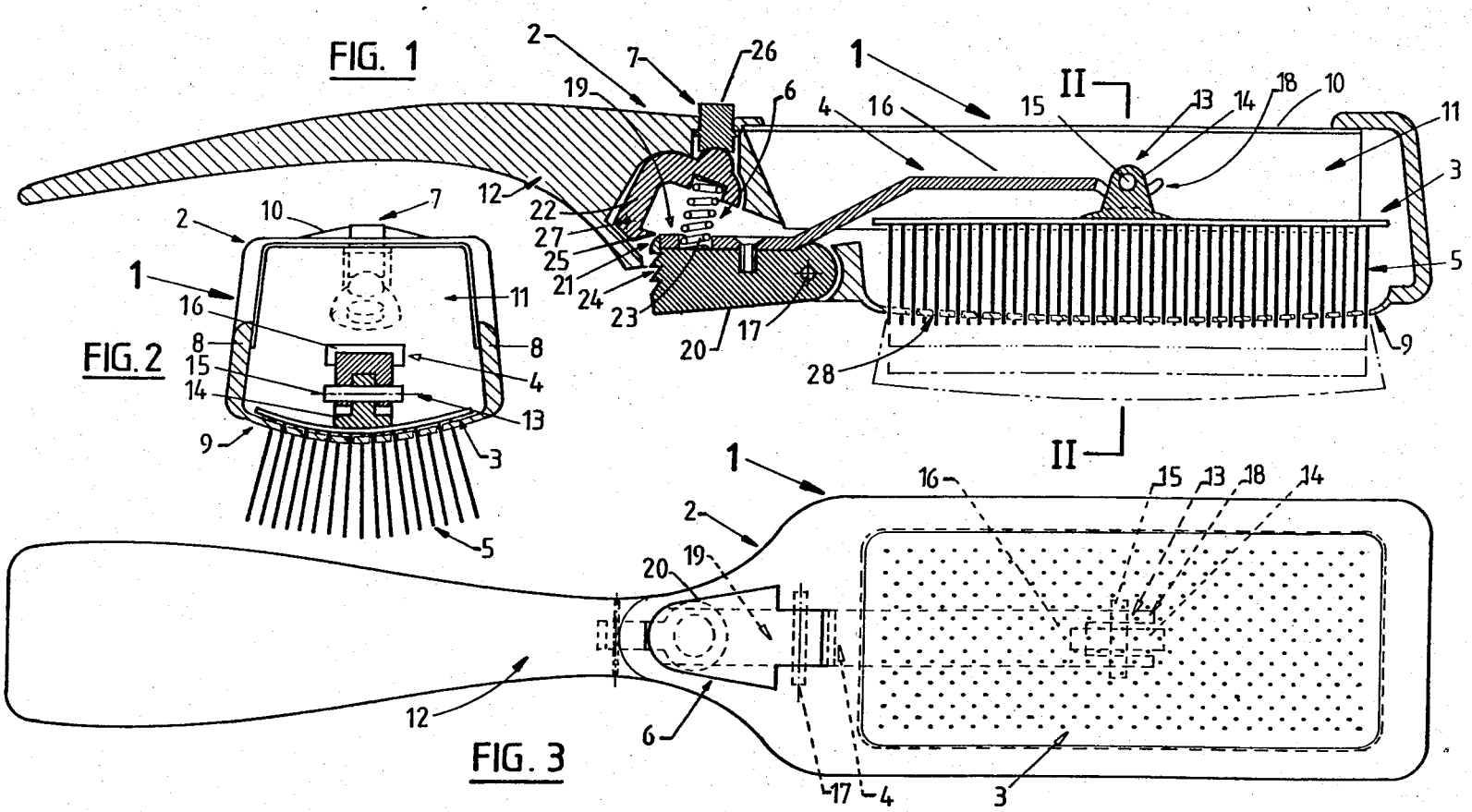
Figure 4:
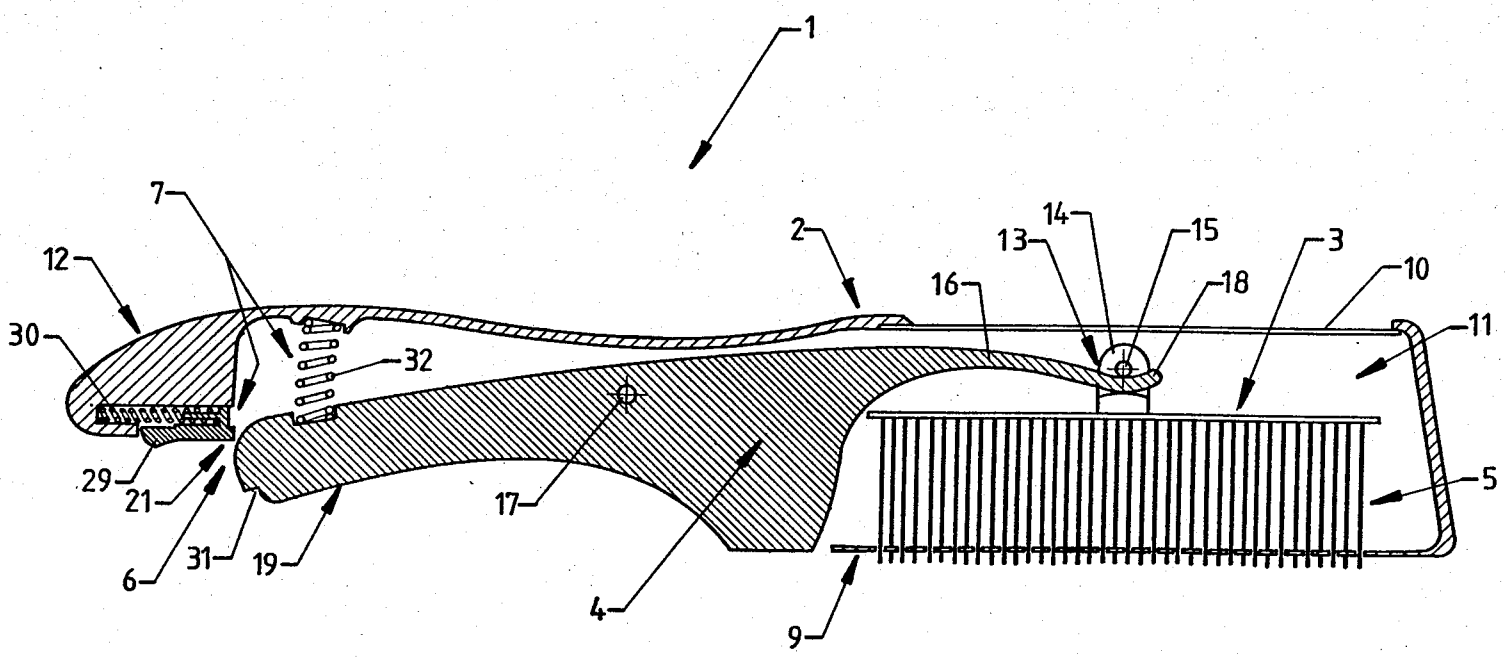

Aspects of the present invention will now be described by way of example only with reference to the accompanying drawings in which:

FIG. 1: is a diagrammatic side view of a brush with retractable bristles in accordance with one possible embodiment of the present invention, and FIG. 2: is a diagrammatic end view of the brush with retractable bristles as shown in FIG. 1, and FIG. 3: is a diagrammatic bottom view of a brush with retractable bristles as shown in FIGS. 1 and 2, and FIG. 4: is a diagrammatic side view of a brush with retractable bristles in accordance with a further possible embodiment of the present invention.

A retractable brush in accordance with the present invention may be fabricated in any suitable material such as wood, or moulded in any suitably mouldable material such as plastics, fibreglass or the like. The bristles may be fabricated in flexible or rigid plastics as required, fibre or natural fibre.

The body may incorporate a handle means either as an integral part of the body or fixed separately thereto.

Alternatively, the brush body may be shaped so as to fit comfortably in the hand thereby obviating the need for a handle means.

The bristles are mounted to a bristle mounting member which may comprise a reciprocally movable plate disposed within the body of the brush.

The plate can be rigid, or alternatively it may be fabricated in a material which provides for a degree of flexibility such that it can conform to the shape of an interior surface of the brush body thereby allowing the bristles to extend as far as possible out from the body, or to splay when extended.

The bristles may be extensible, from the underside of the brush body, or alternatively from the underside and/or the sides of same.

Where the bristles are extensible from the sides they can be fixed to a bristle mounting member which is curved. A retractable hair brush having this bristle configuration is particularly suitable for use as a hair curling brush.

Each bristle may be aligned with and slidably mounted through commensurately dimensioned apertures in the walls of the brush. The apertures may be dimensioned to permit only the passage of the bristles therethrough such that retraction of the bristles dislodges hair and other debris which may become lodged around the bristles.

The alignment of the bristles with the apertures can be maintained by ensuring that when the bristle mounting member is fully retracted the tips of said bristles are always within the apertures of the walls, and/or base of the brush body.

It should be appreciated that walls having perforations through which the bristles may extend are not necessary to the function of a retractable hair brush and that the bristles can be cleaned by retracting the bristles into the brush body through the teeth of a comb.

The bristle mounting member and the bristles may be caused to move reciprocally by operation of a positional support means which comprises a lever or arm pivotally mounted with respect to the body of the brush, said arm is connected to the bristle mounting member at one end and the opposite end of same is located such that pressure can be applied to same so as to pivot the arm and thereby cause the bristles to extend from the body of the brush.

A biasing means, which may be a spring or other resilient member is mounted with respect to the positional support member such that the positional support member is biased into an actuable position.

A locking means is provided to maintain the bristles in their extended position. Said locking means may comprise an engaging means designed to engage the positional support member once the bristle shave extended a certain distance.

Said engaging means may for instance comprise a ratchet pivotally mounted with respect to the positional support member such that the free end of the positional support member can be depressed thereby causing the bristles to extend, but the ratchet will not permit the positional support member to return to its former position.

Said engaging means may be disengaged by a plunger means which can be mounted with respect to the ratchet such that said plunger means can cause the ratchet to turn on its pivot away from the positional support member thereby disengaging same.

Alternatively, the locking means may comprise a reciprocally mounted rod slidably mounted with respect to the positional support member of a trigger which may be integrally formed with or attached to the support member, and a plurality of apertures formed in the trigger which are alignable with the rod and engagable by same, the arrangement being such that when the rod engages the trigger/positional support member the positional support member is locked in a particular position. The said rod may be resiliently mounted so as to facilitate the withdrawal of same from its engaging position with the positional support member.

In a further embodiment, the locking means may comprise a slidably mounted catch biased against the free end of the positional support member, said free end having one or more indentations which are engagable by the catch when the free end is depressed sufficiently. Release of the locking means is effected manually by forcing back the catch until it disengages the positional support member and allows it to return to its former actuable position.

One preferred embodiment of the present invention will now be described by way of example.

With reference to FIGS. 1,2 and 3 and by way of example only, a retractable brush generally indicated by arrow 1 comprises a body generally indicated by arrow 2, a bristle mounting member generally indicated by arrow 3, disposed within the body 2 and supported by a positional support member generally indicated by arrow 4, a plurality of bristles generally indicated by arrow 5 supported by said mounting member 3, means to actuate said positional support member generally indicated by arrow 6 so that the bristles 5 are extensible from the body 2 and lockable in that position, and means to actuate said positional support member to withdraw the bristles generally indicated by arrow 7 in relation to the body for the purpose of cleaning the bristles.

The body of the brush 2 has side walls 8, a base generally indicated by arrow 9 and an upper surface 10 which define a chamber or hollow compartment generally indicated by arrow 11 in which the reciprocally movable bristles and support member are disposed.

Said chamber 11 is dimensioned so as to house the bristle mounting member and bristles when they are retracted within the body.

A handle means generally indicated by arrow 12 is integrally formed with the body 2.

The bristle mounting member comprises a plate which is shaped to conform with the contour of the inner surface of the base 9.

The positional support member 4 is pivotally connected to the bristle mounting member 3 by means of a connecting means generally indicated by arrow 13 mounted with respect to the mounting member 3. Said connecting means 13 comprises a lug 14 and a rod or axle 15 which is engaged by the positional support member.

The positional support member 4 comprises an arm 16 which is pivotally mounted with respect to the body by a pivot 17. Said arm has a driving end generally indicated by arrow 18 which is pivotally connected to the connecting means 13 of the mounting member 3 and a free end generally indicated by arrow 19, the arrangement being such that pressure applied to the free end causes the driving end 18 and hence the mounting member 3 to move reciprocally within the body 2.

A trigger 20 is located with respect to the free end 19 of the positional support member 4. Said trigger is disposed outwardly from the body and is housed partially within the body 2 and handle 12 such that when the trigger is depressed into the body of the brush, the positional support member 4 drives the bristle mounting member.

A locking means for the positional support member generally indicated by arrow 21 comprises a pivotally mounted catch or ratchet 22 which is engagable with the trigger 20, and a biasing means 23, which comprises a spring, seated between the positional support member 4 and ratchet 22.

The trigger 20 incorporates a plurality of serrations generally indicated by arrow 24 which are engagable by a tongue 25 extending from the ratchet 22, the arrangement being such that when the trigger 20 is depressed thereby compressing the spring 23 the tongue 25 is caused to engage a serration 24.

The configuration of the ratchet and serrations is such that while the ratchet allows the trigger to be depressed, the trigger cannot resume its former position without release of the ratchet. In this way, the bristles can be held in their extended position.

Each serration 24 in the trigger 20 can be engaged by the ratchet 22 thereby providing a means of selecting a preferred setting for the degree of extension of the bristles 5.

The means 7 employed to actuate said positional support member to withdraw the bristles by disengaging the locking means 21 comprises a plunger 26 which is reciprocally mounted with respect to the body, and is held in contact with the ratchet 22 by means of the spring 23, the arrangement being such that with the application of pressure to the plunger 26 the ratchet turns on its pivot 27 a sufficient distance to cause it to disengage the serrations 24 thus allowing the spring 23 to bias the free end 19 of the positional support member 4 to its former actuable position which in turn causes the retraction of the bristles into the body.

The bristles 5 extend through a plurality of apertures generally indicated by arrow 28 in the undersurface 10 of the brush. Said apertures are dimensioned so as to permit only the passage of the bristles therethrough such that retraction of the bristles dislodges hair and other debris which may have become lodged around the bristles.

When the bristles are retracted the tips of the bristles remain within the apertures 28 so as to maintain the alignment of the bristles with the apertures.

The means to actuate the positional support member so that the bristles are extensible from the body and lockable in that position and the means to actuate said positional support member to withdraw the bristles in relation to the body are located conveniently where the handle means joins the brush body such that actuation of same can be readily effected by the same hand by which the operator holds the brush.

In another preferred embodiment shown in FIG. 4 the means 6 to actuate said positional support member so that the bristles are extensible from the body and lockable in that position comprises a positional support member 4 having an elongate free end generally indicated by arrow 19 which when depressed with respect to the handle 12 actuates the bristles 5. The bristles are held in their extended position by a locking means 21 which comprises a slidably mounted catch 29 biased by a spring 30 against the free end of the positional support member, said free end 19 having a notch 31 which is engagable by the catch 29 when the free end is depressed sufficiently to allow the catch to slide into the notch.

The means 7 to actuate said positional support member to withdraw the bristles 5 comprises the locking means 21 which co-acts with a compressed spring 32 which is mounted between the brush body and the positional support member, the arrangement being such that the spring 32 is compressed when the bristles are extended and held in that state of compression by the catch 29 so that when the catch disengages the positional support member the spring 32 biases the free end of the positional support member back to its actuable position thereby retracting the bristles into the brush body.

Aspects of the present invention have been described by way of example only and it will be appreciated that modifications and additions thereto may be made without departing from the spirit or scope thereof as defined in the appended claims.

We claim:

1. A brush with retractable bristles which comprises:

a body;

a bristle mounting member disposed within the body for the bristles;

a positional support member which is pivotally mounted with respect to the body and comprises an arm with a driving end which is connected to the bristle mounting member and a free end to which pressure can be applied for the purpose of moving the bristle mounting member reciprocally within the body;

a biasing means to actuate said positional support member to withdraw the bristles in relation to the body for the purpose of cleaning the bristles; and, means to secure the positional support member in a position where the bristles extend from the body, said means comprising a reciprocal catch slidably mounted with respect to the brush body, a biasing means which biases the catch against the free end of the positional support member and one or more indentations in the free end of the positional support member which are engageable by the biased catch when the catch is aligned with an indentation by depression of the free end of the positional support member.

2. A brush with retractable bristles as claimed in claim 1 wherein the means to actuate the positional support member to withdraw the bristles in relation to the body comprises a biasing means which normally biases the free end of the positional support member into an actuable position but which is compressed by the positional support member and held in the compressed state by the catch when the bristles are extended from the body, such that when the catch is caused to disengage the positional support member the compressed biasing means retracts the bristles by forcing the positional support member back to its original actuable position.

3. A brush with retractable bristles a claimed in claim 1 wherein the free end of the positional support member is biased into an actuable position by a biasing means such that it projects clear of the body of the brush and such that the depression of same into the brush body causes the bristles to extend from the body.

* * * * *